US005834926A

United States Patent [19]

Kadanka

[11] Patent Number: 5,834,926

[45] Date of Patent: Nov. 10, 1998

[54] BANDGAP REFERENCE CIRCUIT

[75] Inventor: Petr Kadanka, Roznov pod Radhostem, Czechoslovakia

[73] Assignee: Motorola, Inc., Schaumburg, Ill.

[21] Appl. No.: 907,971

[22] Filed: Aug. 11, 1997

[51] Int. Cl.[6] ..... G05F 3/16

[52] U.S. Cl. ..... 323/313; 323/907; 327/539

[58] Field of Search ..... 323/313, 314, 323/907; 327/539

[56] References Cited

U.S. PATENT DOCUMENTS

| | | | |
|---|---|---|---|
| 4,375,595 | 3/1983 | Ulmer et al. | 307/297 |
| 4,795,961 | 1/1989 | Neidorff | 323/314 |
| 4,896,094 | 1/1990 | Greaves et al. | 323/314 |
| 4,926,138 | 5/1990 | Castello et al. | 330/253 |
| 4,939,442 | 7/1990 | Carvajal et al. | 323/281 |
| 4,994,729 | 2/1991 | Taylor | 323/314 |
| 5,391,980 | 2/1995 | Thiel et al. | 323/314 |
| 5,453,679 | 9/1995 | Rapp | 323/313 |
| 5,471,131 | 11/1995 | King et al. | 323/314 |
| 5,479,091 | 12/1995 | Chlovper | 323/312 |
| 5,563,504 | 10/1996 | Gilbert et al. | 323/316 |
| 5,629,612 | 5/1997 | Schaffer | 323/313 |

OTHER PUBLICATIONS

Motorola Technical Developments, "CMOS Bandgap circuit" by Andreas Rusznyak, vol. 30, pp. 101–103 1997.

IEEE Journal of solid state circuits "A programmable CMOS dual channel interface processor for telecommunications applications", Bhupendra K. Ahuja, Paul R. Gray, Wayne M. Baxter and Gregory T. Uehara, vol. SC19, No.6, Dec. 1984 pp. 870–899.

Song, B.S., Gray P.R. A precision curvature–compensated CMOS bandgap reference, IEEE Journal of solid state circuits, vol. SC–18, No. 6, Dec. 1983, pp. 634–643.

Horowitz P. Hill W., "The art of electronics", second edition, Cambridge University Press, chapter 6.15, Bandgap ($V_{BE}$) reference, pp. 335–341 1980.

*Primary Examiner*—Adolf Berhane

*Attorney, Agent, or Firm*—Robert M. Handy

[57] ABSTRACT

In a bandgap reference circuit (200), a base-emitter voltage $V_{BE}$ with a first temperature coefficient $TC_1$ is added to a voltage difference $\Delta V$ with a second, opposite temperature coefficient $TC_2$ by two resistors (210,220). The bandgap reference circuit (200) comprises current sources (271–276) and bipolar transistors Q(1) to Q(K) (281–286) of pnp-type and npn-type. Current densities in Q(1) to Q(6) are distributed so that some base-emitter voltages $V_{BEk}$ in Q(1) to Q(6) are different. The bases and emitters of Q(1) to Q(6) are serially coupled so that pn-junctions are arranged in a alternative directions, thus adding only the differences of $V_{BEk}$ but not adding their absolute values. This feature makes the circuit (200) applicable in a low voltage environment. The ratio between the two resistors (210,220) can have a value which minimizes noise voltages $V_N$ so that external filtering capacitors are not required.

21 Claims, 4 Drawing Sheets

— PRIOR ART —

300

BANDGAP REFERENCE CIRCUIT

FIELD OF THE INVENTION

The present invention in general relates to electronic circuits, and in particular relates to circuits providing temperature independent reference voltages.

BACKGROUND OF THE INVENTION

It is common in the electronic art to use reference voltage in connection with complex circuits and systems. Various circuits for generating reference voltages are well known, including those which employ temperature compensation so that the reference voltage is substantially independent of the temperature over a significant range.

Bandgap reference circuits are known, for example, from:

[1] Horowitz, P., Hill, W.: The art of electronics, Second Edition, Cambridge University, Press, chapter 6.15: Bandgap ($V_{BE}$) reference, pages 335–341;

[2] Ahuja, B. et. al.: A programmable CMOS Dual Channel Interface Processor for Telecommunications Applications, IEEE Journal of Solid State Circuits, vol. SC-19, no. 6, December 1984;

[3] Song, B. S., Gray, P. R.: A Precision Curvature-Compensated CMOS Bandgap Reference, IEEE Journal of Solid-State Circuits, vol. SC-18, No. 6, December 1983, pages 634–643;

[4] U.S. Pat. No. 4,375,595 to Ulmer et. al.;

[5] Ruszynak, A.: CMOS Bandgap Circuit, Motorola Technical Developments, volume 30, March 1997, published by Motorola Inc., Schaumburg, Ill. 60196, pages 101–103; and

[6] U.S. Pat. No. 4,896,094 to Greaves et. al.

The principle used in the circuits described in [1] and [2], as with many other similar circuits, is based on adding two voltages whose temperature coefficients have opposite signs. One voltage is generated by a current of a given amount flowing through a diode or bipolar transistor resulting in a negative temperature coefficient and the other voltage is obtained across a first resistor through which a current flows whose value is defined by the voltage difference on two diodes or bipolar transistors operating on different current density levels and by a second resistor.

FIG. 1 illustrates a simplified circuit diagram of prior art bandgap reference circuit 100 (hereinafter circuit 100). Circuit 100 comprises operational amplifier 130 ("op amp"), resistor 110 having a value of $R_1$, resistor 120 with value $R_2$, resistor 115 having value $R_{C1}$, resistor 125 having value $R_{C2}$, transistor 135 (also: $Q_0$), transistor 116 (also: $Q_{i1}$), transistor 126 (also: $Q_{i2}$), and current source 160. Circuit 100 is coupled to a first potential VCC at line 191 and to a second potential GND at line 192. Circuit 100 provides a reference potential $V_{BG}$ at line 195. Potential $V_{BG}$ is, preferably, referred to the GND potential. In the example of FIG. 1, transistors $Q_{i1}$, $Q_{i2}$, and $Q_0$ are bipolar transistors of negative-positive-negative (npn) type having, as illustrated representative for $Q_0$, a base 137 "B", an emitter 138 "E", and an collector 136 "C". Preferably, the VCC potential is positive compared to the GND potential. Connections of op amp 130 to lines 191 and 192 are well known in the art and not shown for simplicity.

Resistors 115 ($R_{C1}$) and 125 ($R_{C2}$) couple the collectors C of transistors 116 ($Q_{i1}$) and 126 ($Q_{i2}$), respectively, to line 191 (VCC). The emitters E of transistors 116 ($Q_{i1}$) and 126 ($Q_{i2}$) are coupled together to current source 160 which is itself coupled to line 192 (GND). The collector C of transistor 135 ($Q_0$) is coupled to line 191. The emitter E of transistor 135 ($Q_0$) is coupled at node 111 to line 192 via serially resistors 110 ($R_1$), node 112, and 120 ($R_2$). The emitter E of $Q_0$ (node 111) is coupled also to the base B of $Q_{i2}$. Node 112 is coupled to the base B of $Q_{i1}$. Collectors C of $Q_{i1}$ and $Q_{i2}$ are coupled to negative input 131 and positive input 132, respectively, of op amp 130. Output 133 of op amp 133 is coupled to the base B of $Q_0$ and forms thereby line 195 ($V_{BG}$).

For further explanation, $V_{R1}$ is a voltage across resistor 110 (between nodes 111 and 112); $V_{R2}$ is a voltage across resistor 120 (between node 112 and line 192); $V_{BE0}$, $V_{BEi1}$, and $V_{BEi2}$ are voltages across bases (B) and emitters (E) of transistors $Q_0$, $Q_{i1}$, and $Q_{i2}$, respectively. Currents $I_{i1}$ and $I_{i2}$ are generated by current source 160 and flow through collectors (C) and emitters (E) of transistors $Q_{i1}$ and $Q_{i2}$, respectively. For simplicity, base currents are neglected.

As illustrated by an encircled uppercase letter M, the values $R_{C2}$ and $R_{C1}$ of resistors 125 and 115 are, preferably, in the ratio of:

$$M=R_{C2}/R_{C1}, \tag{1}$$

with the slash / standing for division. As illustrated by encircled N, the emitter areas $A_{i1}$ of $Q_{i1}$ and $A_{i2}$ of $Q_{i2}$ are, preferably, related as:

$$N=A_{i1}/A_{i2}. \tag{2}$$

Ratios M and N provide that currents $I_{i1}$ and $I_{i2}$ and current densities in $Q_{i1}$ and $Q_{i2}$ are different. In general, ratios M*N can be expressed as current density ratio Y:

$$Y=M*N \tag{3}$$

Hence, the emitter-base voltages $V_{BEi1}$ (of $Q_{i1}$) and $V_{BEi2}$ (of $Q_i2$) are different. A voltage difference ΔV can be calculated by:

$$\Delta V=V_{BEi2}-V_{BEi1}=V_T*1n(Y), \tag{4}$$

with $V_T$ for a temperature voltage, 1n for logarithm naturalis operation and * for multiplication. $V_T$ is a temperature depended figure known in the art and described e.g., in [1] as $$V_T=k*T/e_0, \tag{5}$$

with $k=1.38*10^{-23}$ Joule/Kelvin, $e_0=1.60*10^{-19}$ Coulomb, and T the absolute temperature in Kelvin. For T=300K, $V_T$ is around 26 mV (millivolts). Voltage difference ΔV appears as $$V_{R1}=\Delta V \tag{6}$$

across resistor 110 and drives a current $\Delta V/R_1$. Voltage $V_{R2}$ across resistor 120 is formed by the current $\Delta V/R_1$ in resistor 110 according to:

$$V_{R2}=\Delta V*(R_2/R_1) \tag{7}$$

Reference potential $V_{BG}$ at line 195 is:

$$V_{BG}=V_{BE0}+V_{R1}+V_{R2} \tag{8}$$

or, using equations (3) and (6), $$V_{BG}=V_{BE0}+(1+R_2/R_1)*V_T*1n(Y) \tag{9}$$

or, more simple written with $X=(1+R_2/R_1)*1n(Y)$, $$V_{BG}=V_{BE0}+X*V_T \quad (10)$$

The temperature dependence of equation (10) is obtained by forming the first deviation (dT/T) over the temperature T:

$$dV_{BG}/dT=dV_{BE0}/dT+X*dV_T/dT=TC_1+TC_2 \quad (11)$$

The first term $V_{BE0}$ in (10) being approximately $V_{BE0}$=0.6 volts has a first, negative temperature coefficient $TC_1=dV_{BE0}/dT$ of e.g., −2 millivolts/Kelvin. By choice of $R_1$, $R_2$, Y (M and N), the second term $X*V_T$ of (10) can have an temperature coefficient $TC_2$ of e.g., +2 millivolts/Kelvin. Preferably, $TC_1$ is related to $TC_2$ by $$TC_2 \approx |TC_1|*(-1), \quad (12)$$

with ≈ for being substantially equal, | for absolute value, (−1) for opposite sign, and * for multiplication. Using equation (5), the second term of (10) $X*V_T$ is expressed as:

$$X*V_T=X*(k/e_0)*t \quad (13)$$

or in the deviation form for $TC_2$=2 millivolts/Kelvin $$TC_2=2\ mV/K=X(k/e_0) \text{ for } X\approx 23 \quad (14)$$

The value of X≈23 is a convenient value for further discussions.

A noise voltage $V_N$ is superimposed on $V_{BG}$. The noise voltage $V_N$ can result from e.g., thermal noise on resistors 110 ($R_1$), 120 ($R_2$), transistors 116 and 126. The noise voltage is related to $R_1$ and $R_2$ as approximated by:

$$V_N \sim R_2/R_1, \quad (15)$$

with the ~ symbol for "proportional". However, for $X=(1+R_2/R_1)*1n(Y)\approx 23$ it is inconvenient to reduce the ratio $R_2/R_1$ to low values, because of a difficult implementation of high Y=M*N values in the 1n(Y) part (equation 3).

As known in the art, the noise voltage $V_N$ can be filtered out by external capacitor 150 having a capacity of e.g., between 1 to 100 nano farads. Such capacitors are difficult to integrate into circuit 100. As shown by dashed lines in the example of FIG. 1, external capacitor 150 is coupled between lines 195 ($V_{BG}$) and 192 (GND). When circuit 100 is integrated, then external capacitor 150 is an external component which is not wanted for consuming e.g., space.

In another approach, Ahuja in FIG. 6 of [2] and Ruszynak in [5] show that transistors (such as e.g., $Q_{i1}$ and $Q_{i2}$ of FIG. 1) can be implemented by multiple transistors of the same type which are serially coupled ("stacked"). The voltage difference ΔV is thereby enlarged. However, N serial coupled bases and emitters require a supply voltage (e.g., VCC) higher than $N*V_{BE}$. This is, however, not suitable when VCC is a low voltage.

This invention seeks to provide a bandgap reference circuit which mitigates the above mentioned disadvantages.

DETAILED DESCRIPTION OF A PREFERRED EMBODIMENT

According to the present invention, a bandgap reference circuit has serially coupled transistors of alternate type (pnp-npn) to provide the voltage difference ΔV. The Y-ratio providing different current densities is distributed over these transistors. In comparison to the prior art, the $R_2/R_1$ resistance ratio can be decreased so that noise voltage $V_N$ is smaller and needs, preferably, no filtering by an external capacitor.

Figure 2:
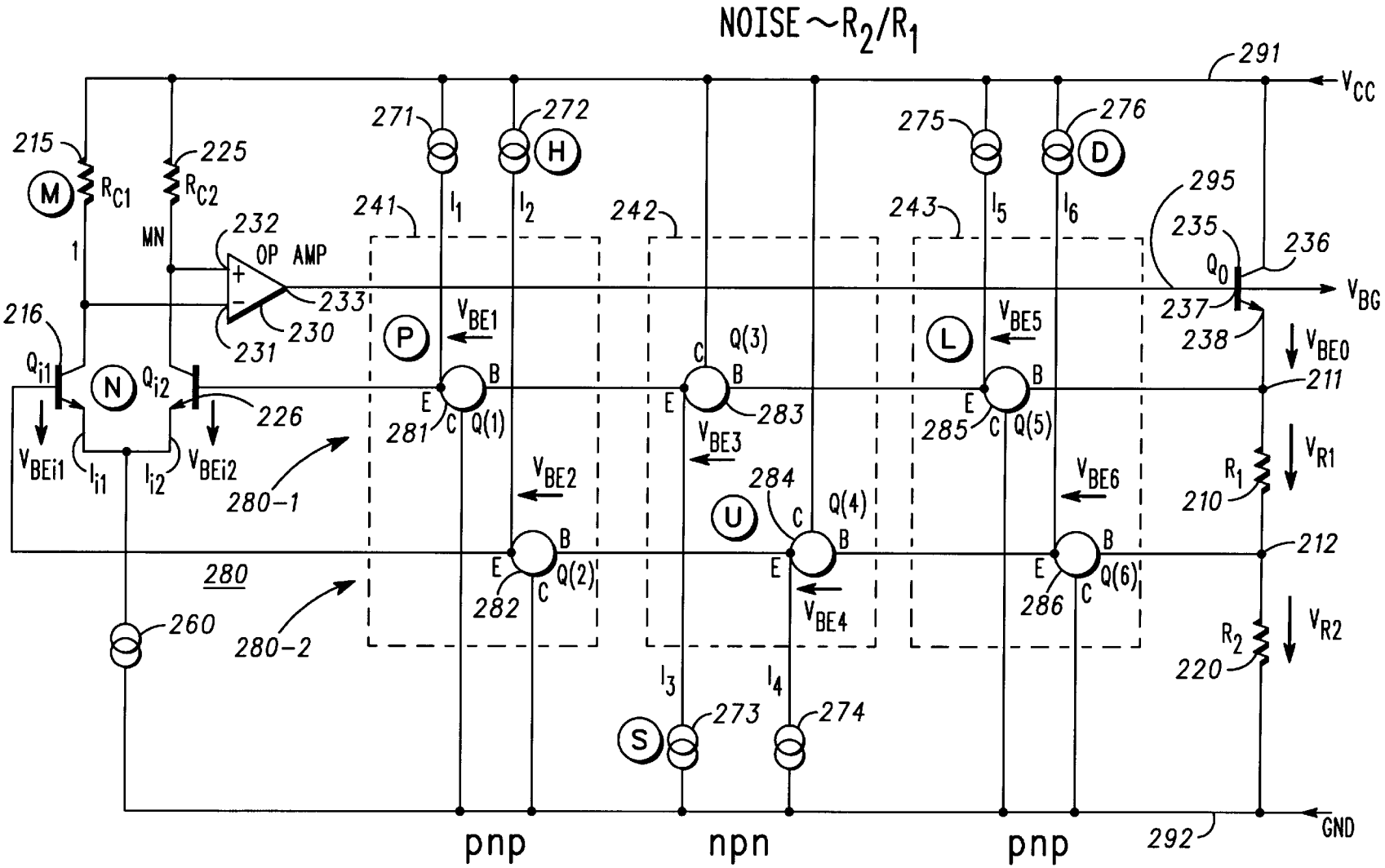
FIG. 2 illustrates a simplified circuit diagram of a bandgap reference circuit of the present invention.

FIG. 2 illustrates a simplified circuit diagram of bandgap reference circuit 200 (hereinafter circuit 200) of the present invention. Circuit 200 is intended to be a non-limiting example. A person of skill in the art is able based on the following description to make changes without departing from the scope of the present invention.

Similarly to prior art circuit 100, circuit 200 comprises operational amplifier 230 ("op amp"), resistor 210 having a value of $R_1$, resistor 220 with value $R_2$, resistor 215 having value $R_{C1}$, resistor 225 having value $R_{C2}$, transistor 235 (also: $Q_0$), transistor 216 (also: $Q_{i1}$), transistor 226 (also: $Q_{i2}$) and current source 260. Reference numbers 110/210, 111/211, 112/212, 115/215, 116/216, 120/220, 125/225, 126/226, 130/230, 131/132, 132/232, 133/233, 135/235, 136/236, 137/237, 138/238 and 160/260 denote similar components in FIGS. 1–2 whose function can, however, differ as explained below. The term 'transistor' is intended to include any device having current and control electrodes, such as for example, bipolar devices. Other types of transistors can also be used. Transistors $Q_{i1}$, $Q_{i2}$, and Q(k) which will be explained later, provide voltages $V_{BE}$ are therefore convenient symbols for pn-junctions, so that these transistors can be replaced also by other components having pn-junctions, such as semiconductor diodes.

Circuit 200 also comprises a plurality of current sources 271, 272, 273, 274, 275, and 276 and a plurality of transistors 281, 282, 283, 284, 285, 286. Further, transistors 281–286 are referred to as Q(k) with k=1 to K=6.

Similarly as circuit 100, circuit 200 is coupled to a first potential VCC at line 291 and to a second potential e.g., GND at line 292. Circuit 200 provides a reference potential $V_{BG}$ at line 295. Potential $V_{BG}$ is, preferably, referred to the GND potential. In the example of FIG. 2, transistors $Q_{i1}$, $Q_{i2}$, and $Q_0$ are bipolar transistors of negative-positive-negative (npn) type (e.g., "a first type") having, as illustrated representative for $Q_0$, base 237 "B", emitter 238 "E", and collector 236 "C". For simplicity, transistors Q(k) are illustrated by circles which also represent voltage sources. The letters "B", "E" and "C" identify the control and current electrodes, respectively. In the example of FIG. 2, transistors Q(1) Q(2), Q(5) and Q(6) are, preferably, of a second or e.g., pnp-type. Transistors Q(3) and Q(4) are, preferably, of the first or e.g., npn-type.

Preferably, the VCC potential is positive compared to the GND potential. Connections of op amp 230 to lines 291 and 292 are well known in the art and not shown for simplicity.

Resistors 215 ($R_{C1}$) and 225 ($R_{C2}$) couple the collectors C of transistors 216 ($Q_{i1}$) and 226 ($Q_{i2}$), respectively, to line 291 (VCC). The emitters E of transistors 216 ($Q_{i1}$) and 226 ($Q_{i2}$) are coupled together to current source 260 which is itself coupled to line 292 (GND). The collector C of transistor 235 ($Q_0$) is coupled to line 291. The emitter E of transistor 235 ($Q_0$) is coupled at node 211 to line 292 via serially resistors 210 ($R_1$), node 212, and 220 ($R_2$). Collectors C of $Q_{i1}$ and $Q_{i2}$ are coupled to negative input 231 and positive input 232, respectively, of op amp 230. Output 233 of op amp 230 is coupled to the base B of $Q_0$ and forms thereby line 295 ($V_{BG}$).

Unlike prior art circuit 100, the emitter E of $Q_0$ (node 211) is coupled to the base B of $Q_{i2}$ via transistors Q(5), Q(3), and Q(1). Preferably, Q(5), Q(3), and Q(1) are serially coupled with node 211 to B of Q(5), E of Q(5) to B of Q(3), E of Q(3) to B of Q(1), E of Q(1) to B of $Q_{i2}$. Node 212 is coupled to the base B of $Q_{i1}$ via transistors Q(6), Q(4), and Q(2). Preferably, Q(6), Q(4), and Q(2) are serially coupled with node 212 to B of Q(6), E of Q(6) to B of Q(4), E of Q(4) to B of Q(2), and B of Q(2) to B of $Q_{i1}$. The order of B and E is thereby not essential. Transistors Q(1) to Q (6) and $Q_{i1}$ and $Q_{i2}$ form thereby transistor chain 280. In some parts of chain 280, transistors Q(k) of first type (npn) and second type (pnp) are serially coupled in an alternate type configuration. For example, transistors Q(5), Q(3) and Q(1) form chain 280-1 of pnp/npn/pnp-types and transistors Q(6), Q(4), and Q(2) from chain 280-2 also of pnp/npn/pnp-types. For the purpose of explanation, the emitters E of transistors Q(1), Q(2), Q(5) and Q(6) are, preferably, coupled to line 291 via current sources 271, 272, 275, and 276, respectively. The collectors C of transistors Q(1), Q(2), Q(5) and Q(6) are, preferably, coupled to line 292. The emitters E of transistors Q(3) and Q(4) are, preferably, coupled to line 292 via current sources 273 and 274, respectively. The collectors C of transistors Q(3) and Q(4) are, preferably, coupled to line 291. Transistors Q(1) to Q(6) are, preferably, configured as emitter follower. To couple emitters E and collectors C between lines 292 and 291 in this way is convenient, but not essential for the present invention. It is only important, that current sources 271–276 drive transistors Q(1) to Q(6) at their current electrodes (e.g., E and C). In another classification, illustrated by dashed frames, transistors Q(1) and Q(2) form transistor pair 241, transistors Q(3) and Q(4) form transistor pair 242, and transistors Q(5) and Q(6) form transistor pair 243.

For further explanation, voltages, currents and other units are introduced. Similar to prior art circuit 100 of FIG. 1, $V_{R1}$ is a voltage across resistor 210 (between nodes 211 and 212); $V_{R2}$ is a voltage across resistor 220 (between node 212 and line 292); $V_{BE0}$, $V_{BEi1}$, and $V_{BEi2}$ are voltages across bases (B) and emitters (E) of transistors $Q_0$, $Q_{i1}$, and $Q_{i2}$, respectively. Currents $I_{i1}$ and $I_{i2}$ are generated by current source 260 and flow through collectors (C) and emitters (E) of transistors $Q_{i1}$ and $Q_{i2}$, respectively. For simplicity, base currents are neglected. $A_{i1}$ and $A_{i2}$ are the emitter areas of transistors $Q_{i1}$ and $Q_{i2}$, respectively and $A_k$ are the emitter areas of transistors Q(k). Voltages $V_{BE1}$ to $V_{BE6}$ are the base-emitter voltages of transistors Q(1) to Q(6). $V_{BE3}$ and $V_{BE4}$ for npn-type transistors Q(3) and Q(4) are positive, e.g., +0.6 volts and the other $V_{BE1256}$ for pnp-type transistors Q(1), Q(2), Q(5), and Q(6) are negative, e.g., −0.6 volts. Current sources 271–276 provide emitter currents $I_1$ to $I_6$ of transistors Q(1) to Q(6).

As illustrated by an encircled uppercase letter M, the values $R_{C2}$ and $R_{C1}$ of resistors 225 and 215 are, preferably, in the ratio of:

$$M=R_{C1}/R_{c2}, \tag{16}$$

with the slash/standing for division. As illustrated by encircled N, the emitter areas $A_{i1}$ of $Q_{i1}$ and $A_{i2}$ of $Q_{i2}$ are, preferably, related as:

$$N=A_{i1}/A_{i2}. \tag{17}$$

Ratios M and N provide that currents $I_{i1}$ and $I_{i2}$ and current densities in $Q_{i1}$ and $Q_{i2}$ are different.

As illustrated by encircled uppercase letters H at current source 272, S at 273, and D at 276, currents $I_k$ of current sources 271–276 are, preferably related as:

$$I_2=H*I_1 \tag{18}$$

$$I_3=S*I_4 \tag{19}$$

$$I_6=D*I_5 \tag{20}$$

As illustrated by encircled P at Q(1), U at Q(4), and L at Q(5), emitter areas $A_k$ are, preferably, related as:

$$A_1=P*A_2 \tag{21}$$

$$A_4=U*A_3 \tag{22}$$

$$A_5=L*A_6 \tag{23}$$

For explanation, it is now assumed that currents $I_1$, $I_4$, $I_5$, areas $A_2$, $A_3$, $A_6$ (these with no encircled letters), have a magnitude of 1. With a current density in a transistor defined as current $I_k$/area $A_k$, the current densities of transistors $Q_{i1}$, $Q_{i2}$, Q(1) to Q(6) are now compared as:

$$1/(M*N) \text{ for } Q_{i1} \text{ and } Q_{i2}, \tag{24}$$

$$1/(H*P) \text{ for Q(1) and Q(2)}$$

$$1/(S*U) \text{ for Q(3) and Q(4)}$$

$$1/(D*L) \textit{ for } Q(5) \text{ and Q(6).}$$

ΔV is now calculated by applying the mesh law as:

$$\Delta V=-V_{i1}+V_{i2}+V_{BE1}-V_{BE2}+V_{BE3}-V_{BE4}+V_{BE5}-V_{BE6} \tag{25}$$

Taking into account the positive and negative values of $V_{BEk}$, for different transistor types, equation (25) is given as:

$$\Delta V=-|V_{i1}|+|V_{i2}|-|V_{BE1}|+|V_{BE2}|+|V_{BE3}|-|V_{BE4}|-|V_{BE5}|+|V_{BE6}| \tag{26}$$

In other words, ΔV is a sum of base-emitter voltages $V_{BEk}$(k=1 to K)

$$\Delta V = \sum_{k=1}^{K} V_{BEk} \tag{27}$$

of serially coupled base and emitter electrodes of a plurality of transistors Q(k)(k=1 to K) partly having a different type (e.g., npn and pnp) so that some of said base-emitter voltages $V_{BEk}$ have different signs (±1) and partly equalize each other.

In analogy to equation (4), ΔV is obtained as:

$$\Delta V=V_T*1n(M*N)+V_T\{-1n(1/P)+1n(H)+1n(S)-1n(1/U)-1n(1/L)+1n(D)\} \tag{28}$$

$$\Delta V=V_T*1n(M*N*P*H*S*U*L*D) \tag{29}$$

$$\Delta V = V_T * \ln(Y) = V_T * \ln\left(\prod_{m=0}^{M} Y_m\right) \tag{30}$$

The Π is the multiplication symbol and $Y_m$ stand for density ratios. For example, density ratios are $Y_0$ for transistors $Q_{i1}$ and $Q_{i2}$, $Y_1$=P*H for transistor pair 241, $Y_2$=S*U for pair 242, and $Y_3$=L*D for pair 243. The total density ratio Y is distributed to substantially all of said plurality of transistors Q(k) and, preferably, also to $Q_{i1}$ and $Q_{i2}$.

Now, using equations (6), (7), (8) and (9) from the background section, $V_{BG}$ is obtained as $$V_{BG}=V_{BE0}+(1+R_2/R_1)V_T*1n(\ \ Y_m) \tag{31}$$

or, written with $X=(1+R_2/R_1)*1n(\Pi Y_m)$, $$V_{BG}=V_{BE0}+X*V_t, \tag{32}$$

Figure 1:
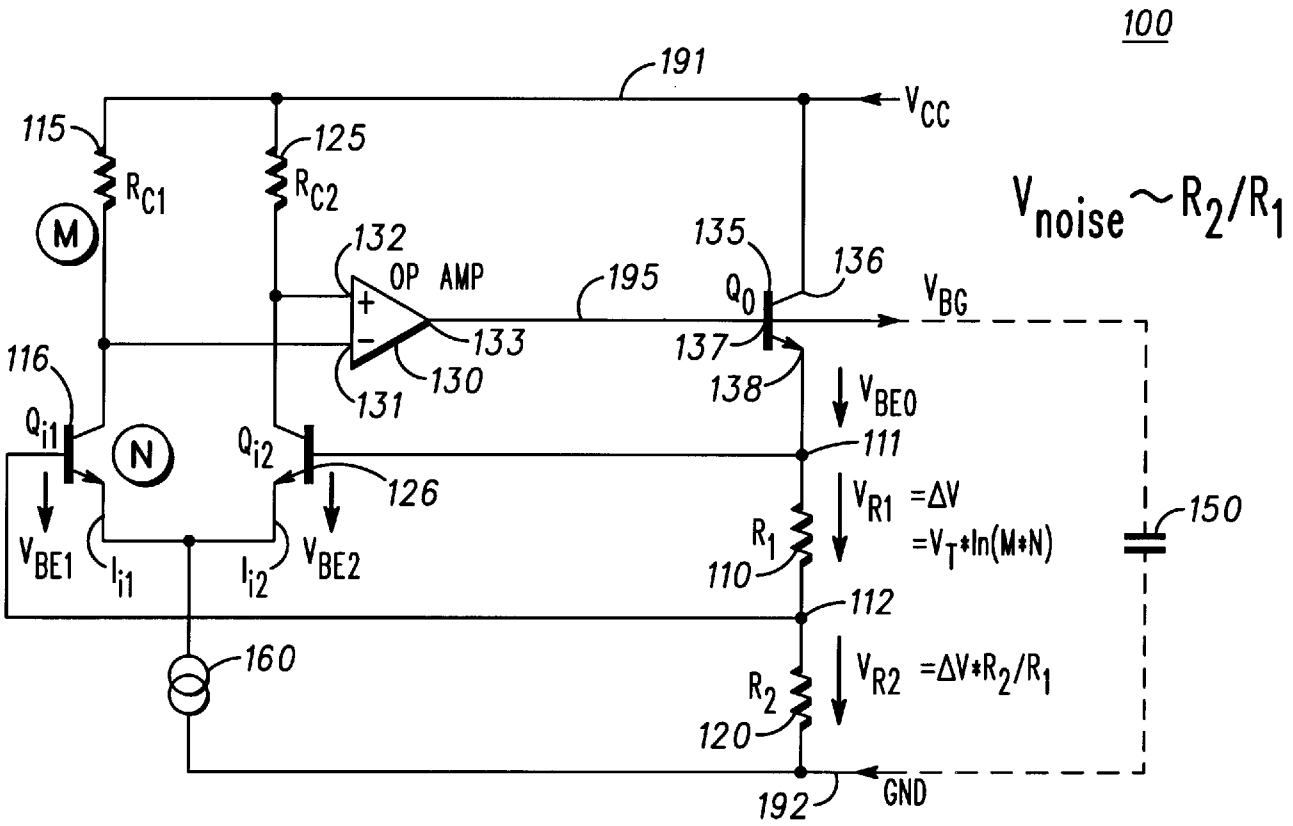
FIG. 1 illustrates a simplified circuit diagram of a prior art bandgap reference circuit.

This result is now compared to the prior art. It is now possible to obtain a high ratio Y so that the ratio $R_2/R_1$ can be reduced. $R_2/R_1$ is still responsible for the noise voltage $V_N$. However, $V_N$ is reduced. Also, external capacitor 150 in prior art circuit 100 of FIG. 1 is no longer required. Although, transistors are coupled serially, circuit 200 does not require higher supply voltage (e.g., VCC). These features makes circuit 200 applicable for low voltage applications.

Figure 3:
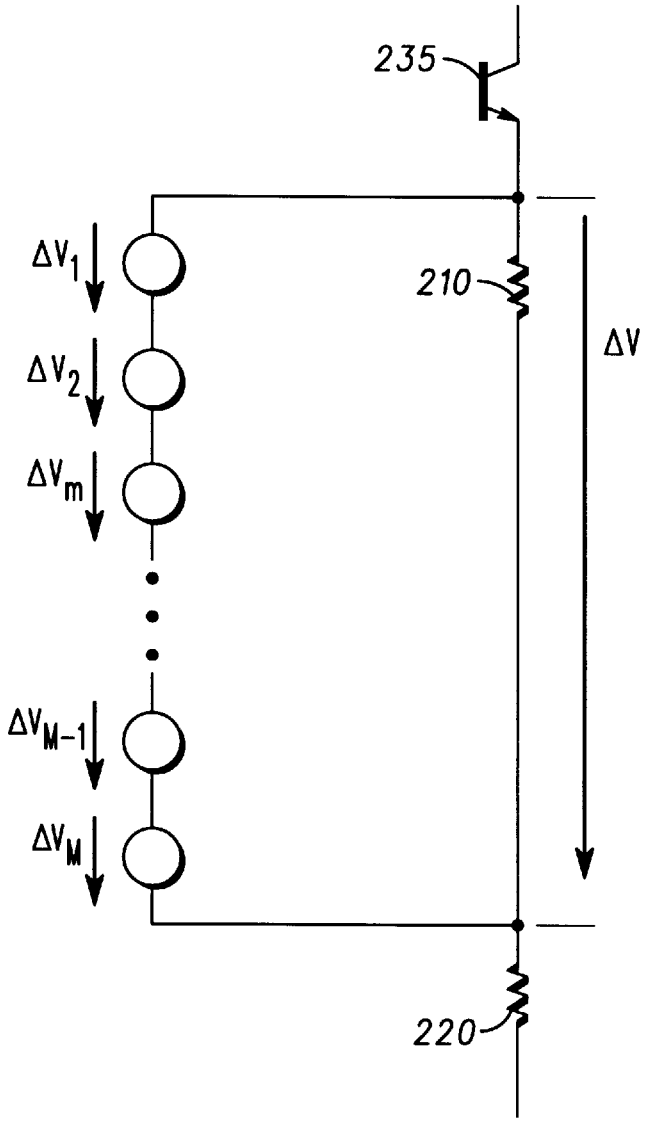
FIG. 3 illustrates the present invention in general by a simplified circuit diagram of a transistor serially coupled with two resistors.

FIG. 3 illustrates the present invention in general by a simplified circuit diagram of transistor 235 serially coupled with resistors 210 (value $R_1$) and 220 (value $R_2$). Transistor 235 and resistors 210 and 220 have already been explained in connection with FIG. 2. Similarly to equation (27), voltage $V_{R1}=\Delta V$ across resistor 210 is defined as a sum of $\Delta V_m$(m=1 to M) of M transistor pairs m.

$$\Delta V = \sum_{m=1}^{M} \Delta V_m \tag{33}$$

Every transistor pair m, such as e.g., pairs 241–243 or $Q_{i1}/Q_{i2}$ of FIG. 2, provides $\Delta V_m$, such as for example, $\Delta V_1=V_{BE1}-V_{BE2}$, $\Delta V_2=V_{BE3}-V_{BE4}$, $\Delta V_3=V_{BE5}-V_{BE6}$, $\Delta V_4=V_{BEi1}-V_{BEi2}$. Every transistor pair has its current density ration $Y_m$, explained in equation (30). Every base-emitter voltage difference $\Delta V_m$ causes a partial noise voltage $V_{Nm}$. The partial noise voltages $V_{Nm}$ are not added linearly as $\Delta V_m$, but added in a non-linear fashion to the above mentioned noise voltage $V_N$:

$$V_N = \left( \sum_{m=1}^{M} V^2_{Nm} \right)^{-1/2} \tag{34}$$

with the supercript "2" at $V_{Nm}$ for square operation and the superscript "−½" symbol for square root operation. $V_N$ can be approximated for constant $V_{Nm}$ to:

$$V_N=M^{-1/2}*V_{Nm} \tag{35}$$

Circuit 200 (FIGS. 2–3) of the present invention is now compared to prior art circuit 100 of FIG. 1. Continuing the discussion of equations (1) of (15) of the background section, convenient values of X≈23 or, for simplicity of calculating X=24, can be calculated by varying parameters Y and $R_2/R_1$:

$$1n(Y)=X/(1+R_2/R_1) \tag{36}$$

$$R_2/R_1=X/1n(Y)-1 \tag{37}$$

For circuit 100, convenient values are 1n(Y)=4, (Y≈54) and $R_2/R_1=5$. While Y=M*N is limited by the different current densities of e.g., two transistors $Q_{i1}$ and $Q_{i2}$, resistor ratio $R_2/R_1=5$ remains high. In circuit 200 of the present invention, Y is distributed and can be increased to e.g., Y=4*4*4*4*4*4*4*4=65536 as explained in equations (16) to (33) with M, N, P, H, S, U, L, D =4. According to equation (35), ratio $R_2/R_1$ is approximated as:

$$R_2/R_1=24/1n(65536)-1\sim1.2. \tag{38}$$

Assuming that, in circuit 100 and in circuit 200, every transistor pair generates an equal partial noise voltage $V_{Nm}$. With equations (15) and (35) a ratio of noise voltages $V_N$(200) of circuit 200 and $V_N$(100) of prior art circuit 100 is calculated as:

$$\begin{aligned} V_N(200)/V_N(100) &= [M^{-1/2} * R_2/R_1]_{200}/[R_2/R_1]_{100} \\ &\approx [4^{-1/2} * 1.2]/5 \\ &\approx [2 * 1.2]/5 \\ &\approx 0.5 \end{aligned} \tag{39}$$

As an advantage of the present invention, circuit 200 has 50% less output noise than prior art circuit 100.

Figure 4:
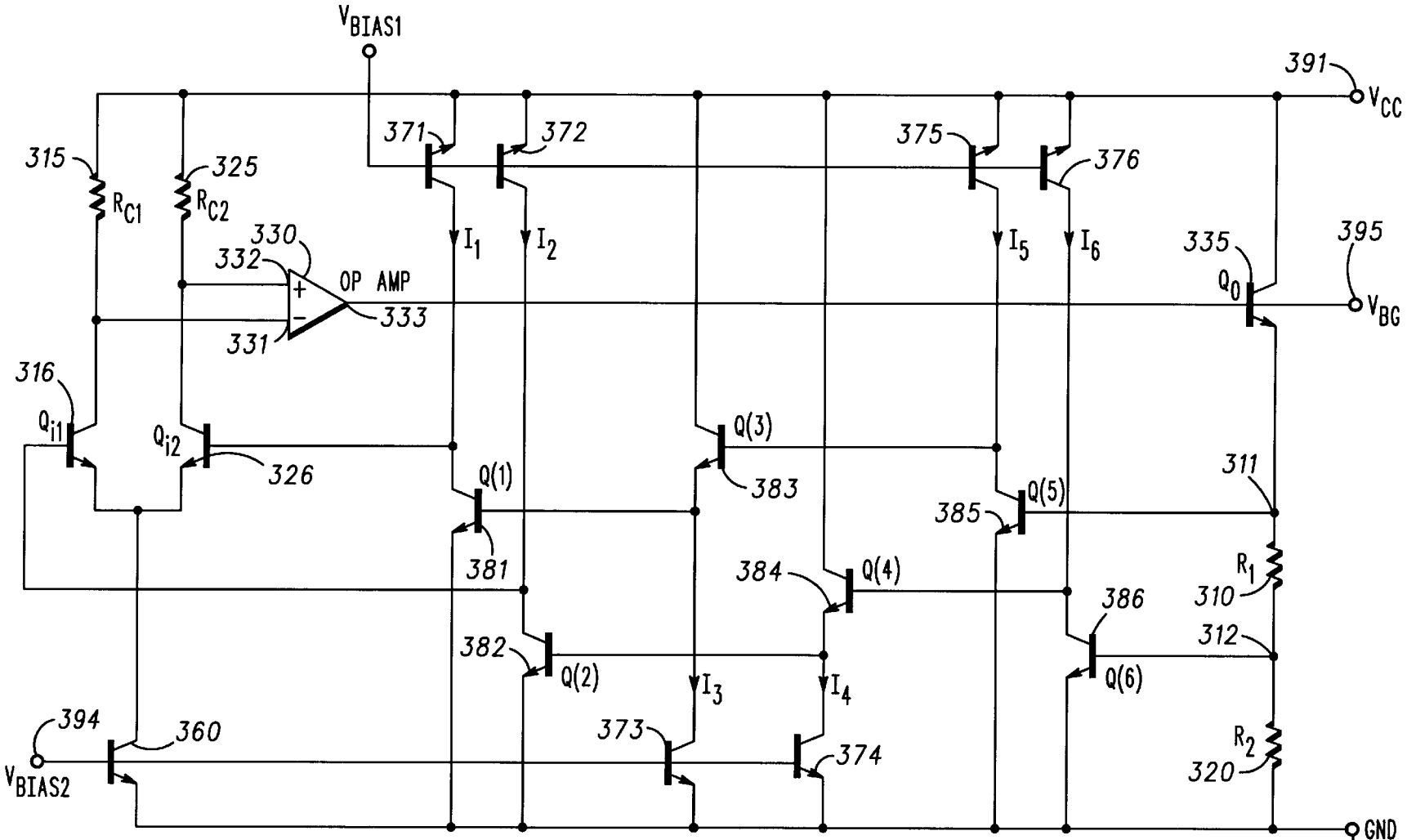
FIG. 4 is a simplified circuit diagram of circuit of FIG. 2 in a preferred embodiment of the invention.

FIG. 4 is a simplified circuit diagram of circuit 300 in a preferred embodiment of the invention. Circuit 300 is an implementation of circuit 200. Reference numbers 210/310, 211/311, 212/312, 215/315, 216/316, 220/320, 225/325, 226/326, 230/330, 231/331, 232/332, 235/335, 260/360, 271/371, 272/372, 273/373, 274/374, 275/375, 2761376, 281/381, 282/382, 283/383, 284/384, 285/385, 286/386, 291/391, 292/392, and 295/395 denote similar components in circuit 200 (FIG. 2) and circuit 300 (FIG. 4). However, their function can differ as explained below.

Circuit 300 comprises operational amplifier 330 ("op amp"), resistors 315 (value $RC_1$), 325 ($RC_2$), 310 ($R_1$), and 320 ($R_2$); npn-transistors 316 (also $Q_{i1}$), 326 ($Q_{i2}$), 335 ($Q_0$) 383 (Q(3)), 384 (Q(4)), 360 (providing $I_{i1}+I_{i2}$), 373 (providing $I_3$) and 374 (providing $I_4$); pnp-transistors 381 (Q(1)), 382 (Q(2)), 385 (Q(5)), 386 (Q(6)), 371 (providing $I_1$), 372 (providing $I_2$), 375 (providing $I_5$), 376 (providing $I_6$); nodes 311 and 312; first supply terminal 391 (at VCC), second supply terminal 392 (at GND), output terminal (for $V_{BG}$), first bias terminal 393 (receiving $V_{BIAS1}$) and second bias terminal 394 (receiving $V_{BIAS2}$).

For convenience of explanation, collector (C or in plural Cs), emitter (E or Es) and base (B or Bs) electrodes of transistors 316, 326, 335, and 381–386 are abbreviated as, for example, C of $Q_{i1}$ standing for a collector of npn-transistor 316. Resistors 315 is coupled to supply terminal 391 and to negative input 331 of op amp 330, Resistor 325 is coupled to terminal 391 and to positive input 332 of op amp 330. C of $Q_{i1}$ is coupled to input 331 of op amp 330. C of $Q_{i2}$ is coupled to input 332 of op amp 330. E of $Q_{i1}$ and E of $Q_{i2}$ are coupled together to C of 360. E of 360 is coupled to supply terminal 392. B of 360 is coupled to bias terminal 394. Output 333 of op amp 330 is coupled to output terminal 395 and to B of $Q_0$. C of $Q_0$ is coupled to supply terminal 391. E of $Q_0$ is coupled to resistor 10 via node 311. Resistor 320 is serially coupled to resistor 310 at node 312 and is coupled to supply terminal 392.

Now, current paths k between terminals 391 and 392 are explained. These paths are in FIG. 4 illustrated vertically. Es of transistors 371, 372, 375, and 376 are coupled to supply terminal 391; and Es of transistors 373 and 374 are coupled supply terminal 392. Bs of transistors 371, 372, 375 and 376 are coupled to bias terminal 393; and Bs of transistors 373 and 374 are coupled to bias terminal 394. Cs of transistors 371–376 are coupled to E of Q(1)–Q(6), respectively. Cs of Q(1), Q(2), Q(5) and Q(6) are coupled to terminal 392; and Cs of Q(3) and Q(4) are coupled to terminal 391. In other words, a number of K=6 current paths k are coupled between terminals 391 and 392. Each current path k is formed by a serial combination of a first and a second transistor, such as e.g., path 1 by 371 and Q(1), path 2 by 372 and Q(2), path 3 by 373 and Q(3), path 4 by 374 and Q(4), path 5 by 375 and Q(5), and path 6 by 376 and Q(6). Preferably, first and second transistors are coupled in such a way that C of the first transistor (e.g., 371–376 is coupled to E of the second transistor (e.g., Q(1) to Q(6)). First transistors (e.g., 371–376) which receive bias voltages, such as, e.g., $V_{BIAS1}$ for 371, 372, 375, and 376 and $V_{BIAS2}$ for 373 and 374 operate as current sources (cf. 271–276 in FIG. 2) and provide currents $I_k$ ($I_1$ to $I_6$). First transistors (371) determine currents $I_k$. Second transistors (Q(k)) are characterized by their emitter areas $A_k$. A person of skill in the art is able to implement first and second transistors in such a way that current densities $I_k/A_k$ second transistors Q(k) are different. Different current densities in second transistors (Q(k)) result in different base-emitter voltages $V_{BEk}$ of Q(k). The number of currents paths is, preferably, K=6, but other numbers, such as K=8, 10, 12, . . . or higher or odd numbers K can also be used.

Now, it is explained how the Bs and Es of $Q_{i1}$, $Q_{i2}$, and Q(k) are coupled to provide ΔV across resistor 310. Connecting lines are shown in FIG. 4 horizontally. B of $Q_{i2}$ is coupled to E of Q(1); B of Q(1) is coupled to E of Q(3); B of Q(3) is coupled to E of Q(5); and B of Q(5) is coupled to node 311. B of $Q_{i1}$ is coupled to E of Q(2), B of Q(2) is coupled to E of Q(4); B of Q(4) is coupled to E of Q(6); and B of Q(6) is coupled to node 312.

The present invention which has been introduced by the examples of circuits 200 and 300 (FIGS. 2–4) is a bandgap reference circuit employing a voltage $V_{BE}$ which is added to a voltage difference ΔV. $V_{BE}$ has a first temperature coefficient (e.g., $TC_1$) and ΔV has a second temperature coefficient (e.g., $TC_2$). A plurality of K current paths k has current sources k (e.g., transistors 371–376) and pn-junctions k (e.g., between B–E of Q(k) ) with areas $A_k$. Current sources and pn-junctions are serially coupled between supply terminals (e.g., between terminals 391 and 392). Current densities $I_k/A_k$ in the pn-junctions k are different so that voltages $V_{BEk}$ across the pn-junctions k in each current path k are also different. The pn-junctions k of adjacent current paths k and k+1 are serially coupled, so that $\Delta V=\Sigma V_{BEk}$(for k=1 to K). A first number $K_1$ of pn-junctions are arranged in a first direction (e.g., with positive $V_{BE}$) and a second number $K_2$of pn-junctions are arranged in a second, opposite direction (e.g., with negative $V_{BE}$). Therefore, only the differences between $V_{BEk}$ (k of $K_1$) and $V_{BEk}$ (k of $K_2$) are added, wherein their absolute values $|V_{BEk}|$ are not added.

The first number $K_1$ of pn-junctions in the first direction are, preferably, base-emitter (B–E) junctions of npn-transistors (e.g., first type) and the second number $K_2$ of pn-junctions in the second direction are B-E junctions of pnp-transistors (e.g., second type). Preferably, the first number $K_1$ is equal to the second number $K_2$. $K_1$ and $K_2$ can have different values and can be related such as by $K_1=K_2+2$ or $K_2=K_1+2$. Circuit 300 in the example of FIG. 4, uses $K_1=2$ npn-transistors (Q(3) and Q(4)) and uses $K_2=4$ pnp-transistors (Q(1), Q(2), Q(5), Q(6)). This is convenient, but other configurations, such with $K_2=4$ (4 pnp-transistors) and $K_1=2$ (2 npn-transistors) are also possible to be implemented.

In the bandgap reference circuit of the present invention, the voltage difference $\Delta V=V_T*1n(Y)$, is obtained with $Y=\Pi Y_m$(for m=1 to M,M≦K/2). $Y_m$ can be considered as the current density ratio of pn-junction pairs, so that current densities are distributed over substantially all current paths.

In other words, the present invention can be described as a reference circuit which comprises a first portion for providing a first voltage (e.g., $V_{BE0}$) with a first temperature coefficient $TC_1$ and a second portion for providing a second voltage with a second, opposite temperature coefficient $TC_2$. The first portion is formed by, e.g., transistor 235/335 in FIGS. 2–4 and the second portion is formed by, e.g., the other transistors, such as, e.g., by transistors $Q_{i1}$, $Q_{i2}$, Q(1), Q(k) to Q(K) (cf. chain 280 in FIG. 2) and current sources (e.g., 271–276/371–376). The second voltage (e.g., ΔV) is added to the first voltage to output voltage $V_{BG}$ which is substantially temperature independent. The second portion has serially coupled transistors Q(k) of alternatively a first type (e.g., npn) and a second type (e.g., pnp). Transistors Q(k) have areas $A_k$ and carry currents $I_k$, thus providing current densities $I_k/A_k$ which are different so that each transistor Q(k) contributes to the second voltage (e.g., ΔV) by a voltage $V_{BEk}$ between two of its electrodes (e.g., B and E). A person of skill in the art is able to modify circuit 300 without departing from the scope of the present invention. For example, he or she can use more than K=6 current paths.

As mentioned in the background section of this specification (equations 9 to 15), it is inconvenient to reduce the resistor ratio $R_2/R_1$ to low values in a prior art circuit (e.g., circuit 100). Prior art circuits, such as, e.g., in [5] and [6] try to overcome this problem by stacking transistors which distribute current densities. However, absolute values of $|V_{BE}|$ are added so that such circuits require supply voltages which are a multiple of $V_{BE}$. According to the present invention, pnp-transistors and npn-transistors, which are arranged in an alternating order, provide a voltage difference ΔV from their different base-emitter voltages $V_{BEk}$. Absolute values $|V_{BEk}|$ are substantially, not added. Circuits 200 and 300 use supply voltages between lines 291 and 292 which are in the range of $V_{BE}$ itself. These features make it possible to operate the circuit in a low voltage environment.

In circuit 200 of the present invention (and in its preferred embodiment 300), the ratio of $R_2$ and $R_1$ of resistors 220 and 210, respectively, is different and the total noise $V_N$ is reduced by e.g., 50%. Circuit 200 can be integrated on a monolithic chip without, e.g., an external filtering capacitor.

It will be appreciated that although only one particular embodiment of the invention has been described in detail, various modifications and improvements can be made by a person skilled in the art based on the teachings herein without departing from the scope of the present invention. Accordingly, it is the intention to include such modifications as will occur to those of skill in the art in the claims that follow.

I claim:

1. A reference circuit, comprising:

a first portion for providing a first voltage with a first temperature coefficient $TC_1$;

a second portion for providing a second voltage with a second, opposite temperature coefficient $TC_2$, said second voltage being added to said first voltage to provide an output voltage $V_{BG}$ which is substantially temperature independent;

said second portion having serially coupled transistors Q(k) being alternatively of a first type and of a second type, each of said transistors Q(k) having areas $A_k$ and carrying currents $I_k$ resulting in current densities $I_k/A_k$ which are different so that each of said transistors Q(k) contributes to said second voltage by a voltage $V_{BEk}$ between two of its electrodes.

2. The reference circuit of claim 1 wherein said first temperature coefficient and said second temperature coefficient have substantially equal absolute values:

$$|TC_1|=|TC_2|.$$

3. The reference circuit of claim 1 wherein said different current densities $I_k/A_k$ of said transistors Q(k) are provided by current sources coupled to said transistors Q(k) which provide different currents $I_k$.

4. The reference circuit of claim 1 wherein said different current densities $I_k/A_k$ of said transistors Q(k) result from different areas $A_k$ of said transistors Q(k).

5. The reference circuit of claim 1 wherein said transistors Q(k) are bipolar transistors having a base electrodes (B), emitter electrodes (E) and collector electrodes (C) so that said $A_k$, $I_k$ and $V_{BEk}$ are:

emitter areas $A_k$, collector currents $I_k$, and base-emitter voltage $V_{BEk}$, respectively.

6. The reference circuit of claim 1 wherein said first portion comprises a bipolar transistor $Q_0$ and wherein said first voltage is a base-emitter voltage $V_{BE0}$ of said bipolar transistor.

7. The reference circuit of claim 1 wherein a number K of said serially coupled transistors Q(k) is an even number.

8. The reference circuit of claim 1 wherein transistors of said first type are npn-transistors and transistors of said second type are pnp-transistors.

9. The reference circuit of claim 1 further comprising a first resistor having a value $R_1$ and a second resistor having a value $R_2$ receiving said second voltage, said first portion and said first and second resistors being serially coupled together so that said output voltage is a sum of said first voltage and of said second voltage multiplied with $(1+R_2/R_1)$.

10. The reference circuit of claim 1 being integrated into a monolithic chip.

11. The reference voltage of claim 1 wherein said second voltage is:

$$\Delta V = \sum_{k=1.}^{K} V_{BEk}$$

12. A circuit providing a reference voltage $V_{BG}=V_{BE0}+(1+R_2/R_1)*V_T*1n(Y)$ which is stabilized for temperature changes dT according to $dV_{BG}/dT=TC_1+TC_2$ and $TC_2 \approx |TC_1|*(-1)$, with $V_{BE0}$ being base-emitter voltage of a first transistor;

with $R_1$ being a value of a first resistor to which a voltage difference $\Delta V=V_T*1n(Y)$ is applied;

with $R_2$ being a value of a second resistor serially coupled to said first transistor with $V_T$ being a temperature voltage;

with Y being a current density ratio;

with $TC_1$ being a temperature coefficient of $V_{BE0}$ with $TC_2$ being a temperature coefficient of $(1+R_2/R_1)*V_T*1n(Y)$ with ≈ for substantially equal, | for absolute value, (−1) for opposite sign, * for multiplication, said circuit being characterized in that (1) said ΔV is a sum of base-emitter voltages $V_{BEk}$(k=1 to K)

$$\Delta V = \sum_{k=1}^{K} V_{BEk}$$

of serially coupled base and emitter electrodes of a plurality of transistors Q(k) (k=1 to K) partly having a different type so that some of said base-emitter voltages $V_{BEk}$ have different signs (±1) and partly equalize each other; and (2) said density ratio Y is distributed to substantially all of said plurality of transistors Q(k).

13. The circuit of claim 12 wherein said current density ratio Y is distributed to substantially all transistor Q(k) by providing said transistors Q(k) with different areas $A_k$ and different currents $I_k$ through said transistors.

14. A circuit, comprising:

an output transistor providing a base-emitter voltage $V_{BE0}$ having a first temperature coefficient $TC_1$;

a resistor coupled to said output resistor;

a plurality of serially coupled first transistors and a second transistors Q(k), said first transistors providing currents $I_k$ through said second transistors, said second transistors each having an emitter area $A_k$ and a base-emitter voltage $V_{BEk}$ resulting in a current density $I_k/A_k$;

said second transistors being of alternative types;

wherein said second transistors are coupled so that a sum ΔV of their $V_{BEk}$ is applied across said resistor and added to said base-emitter voltage $V_{BE0}$, said ΔV having a second temperature coefficient $TC_2$ opposite to $TC_1$ so that an output voltage $\Delta V+V_{BE0}$ is substantially independent of temperature changes.

15. A bandgap reference circuit employing a voltage $V_{BE}$ with a first temperature coefficient which is added to a voltage difference ΔV with a second, opposite temperature coefficient, said bandgap reference circuit being characterized in that is comprises:

a plurality of K current paths identified by an index k, said current paths each having a current source identified by said index k and a pn-junction identified by said index k, said pn-junctions having areas $A_k$ having different current densities $J_k=I_k/A_k$ so that some or all voltages $V_{BEk}$ across said pn-junctions k in each current path k are different, pn-junctions k of adjacent current paths k and k+1 are being serially coupled, so that $$\Delta V=\Sigma V_{BEk}(\text{for } k=1 \text{ to } K),$$

a first number $K_1$ of said pn-junctions being arranged in a first direction and a second number $K_2$ of said pn-junctions are being arranged in a second, opposite direction so that only the differences of $V_{BEk}$ (k of $K_1$) and $V_{BEk}$ (k of $K_2$ ), but not their absolute values are added.

16. The bandgap reference circuit of claim 15 wherein said first number $K_1$ of said pn-junctions in said first direction are base-emitter junctions of npn-transistors; and said second number $K_2$ of said pn-junctions in said second direction are base emitter junctions of pnp-transistors.

17. The bandgap reference circuit of claim 15 wherein said first number $K_1$ equals said second number $K_2$.

18. The bandgap reference circuit of claim 15 wherein $K_1+K_2=K$ is an even number.

19. The bandgap reference circuit of claim 15 wherein ($K_1=2$ and $K_2=4$) or ($K_2=4$ and $K_1=2$).

20. The bandgap reference circuit of claim 15 wherein $K_1=K_2+2$ or $K_2=K_1+2$.

21. The bandgap reference circuit of claim 15 wherein said voltage difference $\Delta V=V_T*1n(Y)$, with temperature voltage $V_T$ and Y being $Y=\Pi Y_m$ (for m=1 to M, $M \leqq K/2$) with $Y_m$ the current density ratio of pn-junction pairs, so that current densities are distributed over substantially all current paths.

* * * * *